United States Patent [19]

Kunii et al.

[11] Patent Number: 4,742,891

[45] Date of Patent: May 10, 1988

[54] ELEVATOR SYSTEM

[75] Inventors: Kazushi Kunii; Terumi Hirabayashi, both of Inazawa, Japan

[73] Assignee: Mitsubishi Denki Kabushiki Kaisha, Japan

[21] Appl. No.: 903,400

[22] Filed: Sep. 3, 1986

[30] Foreign Application Priority Data

Sep. 5, 1985 [JP] Japan ..... 60-196202
Dec. 5, 1985 [JP] Japan ..... 60-273962

[51] Int. Cl.[4] ..... B66B 11/04

[52] U.S. Cl. ..... 187/25; 74/89.15; 74/665 D

[58] Field of Search ..... 187/24, 25, 80, 73, 187/77; 254/7 R, 85, 92, 98, 103; 182/141; 74/424.8 R, 665 A, 665 D, 661, 87.15; 310/80, 83, 112

[56] References Cited

U.S. PATENT DOCUMENTS

| | | | |
|---|---|---|---|
| 1,522,967 | 11/1925 | Meyer et al. | 187/24 |
| 1,564,536 | 12/1925 | Davis et al. | 187/24 |
| 2,873,620 | 2/1959 | Sinclair | 74/661 |
| 3,215,227 | 11/1965 | MacChesney | 187/24 |
| 3,548,677 | 12/1970 | Becker | 74/665 A |
| 4,494,025 | 1/1985 | Fickler | 74/89.15 |
| 4,548,298 | 10/1985 | Born | 187/25 |

FOREIGN PATENT DOCUMENTS

| | | |
|---|---|---|
| 4860261 | 11/1971 | Japan . |
| 48-109657 | 8/1972 | Japan . |
| 5746576 | 8/1980 | Japan . |
| 5746577 | 9/1980 | Japan . |

*Primary Examiner*—Joseph J. Rolla
*Assistant Examiner*—Kenneth Noland
*Attorney, Agent, or Firm*—Leydig, Voit & Mayer

[57] ABSTRACT

A compact and simple elevator system is disclosed which does not require a counterweight, a hoistway rope, a winding drum, safety devices such as an emergency stopping device, a speed governor or the like, and in which the installation space as well as the production costs thereof can be reduced, and which is most suitable for installation in private homes. The elevator system comprises a hoistway, an elevator car accommodated in the hoistway and movable in the vertical direction, a screw shaft vertically disposed in the hoistway and having a screw thread formed on the outer peripheral surface thereof, a rotary element mounted on the elevator car and adapted to be threadedly engaged with the screw shaft, a drive source mounted on the elevator car for driving the rotary element to rotate, and a mechanism for restraining the rotation of the screw shaft at least in the normal operating condition of the elevator system, whereby when the rotary element is driven to rotate by means of the drive source, it is caused to displace vertically along the screw shaft to thereby move the elevator car in the vertical direction.

13 Claims, 4 Drawing Sheets

ELEVATOR SYSTEM

BACKGROUND OF THE INVENTION

1. Field of the Invention

This invention relates to an elevator system particularly adapted for use in small buildings such as private homes.

2. Description of the Prior Art

In recent years, persons of advanced age have been increasing at a rapid rate in Japan and other places in the world, and along with this ageing of society has come an increase in the number of people who desire an elevator system be installed in their two- or three-storied private homes. However, conventional elevator systems have been developed in accordance with demands for large-sized elevator systems in large office buildings, cooperative housing, or the like and if the large-sized conventional elevator systems suitable for these large buildings are miniaturized for use with small-sized buildings such as private homes, there will be many inconveniences particularly from the view points of installation space efficiency, production economy and maintenance costs, etc. Specifically, many elevator systems in general employ a well-bucket type lifting system in which an elevator car and a counterweight are connected to each other by a main or hoisting rope, but this type of lifting system requires a relatively greater installation space for the counterweight as compared with the elevator car, and hence is not suitable for small-sized elevator systems.

On the other hand, there has been known a drum-type elevator system which does not use any counterweight as described, for example, in Mitsubishi Denki Technical Information, volume 57, number 11, page 7(745), FIGS. 2 to 4, issued on Nov. 25, 1983. This drum-type elevator system is constructed such that an elevator car is caused to move vertically by winding and rewinding a hoisting rope around a drum without use of any counterweight. Thus, a drum-type elevator system employing no counterweight can be produced with a small size and suitable for installation in applications with limited available space.

Although in the above-described conventional elevator system, no counterweight is employed, a machine room for installation of an electric motor for driving a drum is required instead, and accordingly, it is essential to provide a machine room in a home installation which thereby take up valuable portion of the relatively small space available in most homes, making it difficult to effectively utilize available space.

Further, the above-described conventional elevator system of the winding drum type requires safety devices including an emergency stopping mechanism, a speed governor and the like which will be operated in case of a break of the main or hoisting rope. In a compact or small-sized elevator system, however, it is unfavorable to employ the winding drum and the safety devices as referred to above in terms of the installation space and the production costs involved.

SUMMARY OF THE INVENTION

In view of the above, the present invention is intended to obviate the above-described problems of the prior art and has for its object the provision of a compact and simple elevator system which does not require a counterweight, a hoisting rope, a winding drum, or safety devices such as an emergency stopping device, a speed governor or the like, and in which the installation space as well as the production costs thereof can be reduced, and which is most suitable for installation in private homes.

It is another object of the present invention to provide an elevator system in which an elevator car can be started to move and stopped in a most smooth manner.

In order to achieve the above object, according to the present invention, there is provided an elevator system which comprises:

a hoistway;

an elevator car accommodated in the hoistway and movable in the vertical direction;

a screw shaft vertically disposed in the hoistway and having a screw thread formed on the outer peripheral surface thereof;

a rotary element mounted on the elevator car and adapted to be threadedly engaged with the screw shaft;

a drive source mounted on the elevator car for driving the rotary element to rotate; and means for restraining the rotation of the screw shaft at least in the normal operating condition of the elevator system, whereby when the rotary element is driven to rotate by means of the drive source, it is caused to displace vertically along the screw shaft thereby to move the elevator ear in the vertical direction.

The above and other objects, features and advantages of the present invention will become apparent from the following detailed description of a few presently preferred embodiments of the invention when taken in conjunction with the accompanying drawings.

DESCRIPTION OF THE PREFERRED EMBODIMENTS

Now, the present invention will be described with reference to a presently preferred embodiment thereof as illustrated in the accompanying drawings.

FIGS. 1 through 5 show an elevator system constructed in accordance with the present invention.

Figure 1:
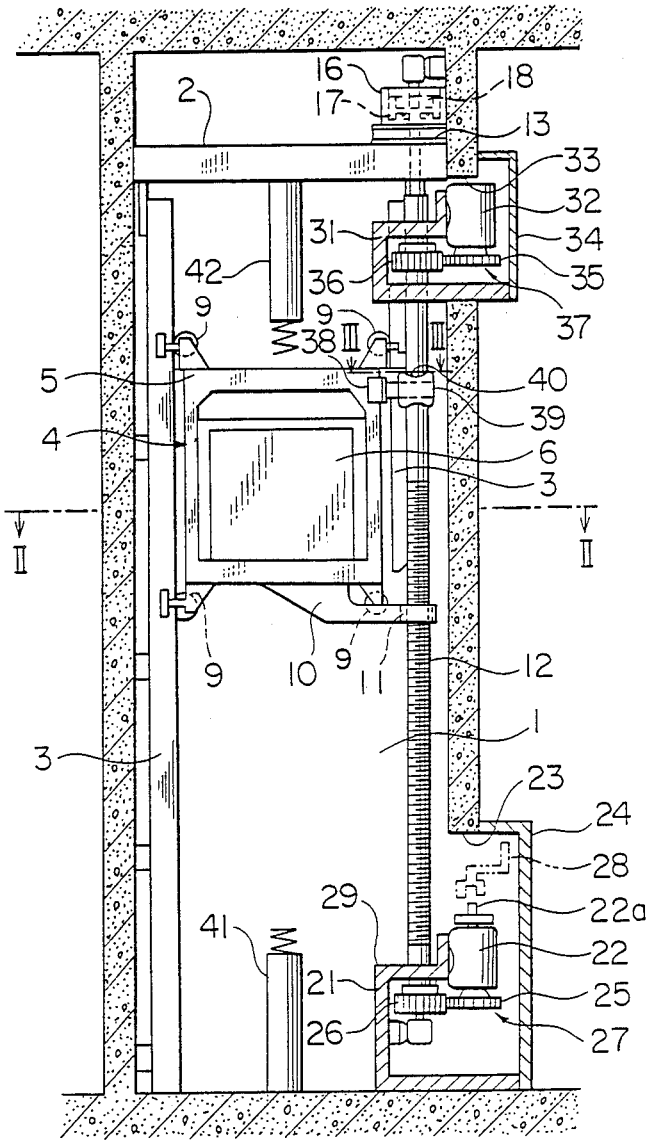
FIG. 1 is a vertical cross sectional view showing an elevator system in accordance with the present invention.
Figure 2:
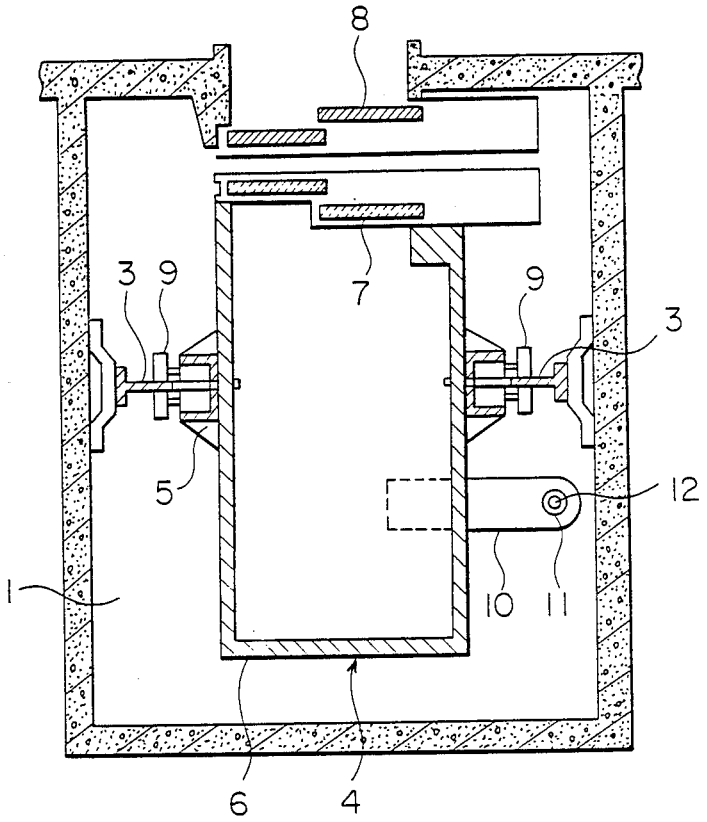
FIG. 2 is an enlarged cross sectional view taken along the line II—II in FIG. 1.

In FIG. 1, the elevator system as illustrated includes a vertically extending hoistway 1 of rectangular cross section on the upper walls of which a support beam 2 is horizontally mounted. A pair of guide rails 3, 3 are vertically disposed in the hoistway 1 and each have their upper end mounted on the support beam 2 and their lower end supported on the bottom surface of the hoistway 1. Disposed between the guide rails 3, 3 is an elevator ear 4 including a car frame 5 and a cabin 6 supported by the car frame 5. The car cabin 6 has an entrance adapted to be closed by a car door 7 as clearly shown in FIG. 2. A hall door 8 corresponding to the car door 7 is provided for closing a hall opening in the hoistway 1 (also see FIG. 2).

The car frame 5 has four groups of guide rollers 9 mounted thereon, each group of guide rollers including three rollers rotatably mounted on the car frame 5 so as to roll on and along the top surface and the side surfaces of the respective guide rails 3, 3 for guiding the vertical movements of the elevator car 4. Disposed at the rear portion of the elevator car 4 is an arm 10 which extends toward one side of the car 4 and which is secured to the bottom surface of the car frame 5. A nut 11 is fixedly mounted on the arm 10 and has a female or internal screw thread of square cross section formed on the inner peripheral surface thereof.

A screw shaft 12 is vertically disposed in the hoistway 1 and is made of a tubular material having a male or external screw thread of square cross section formed on its outer peripheral surface substantially along the length of the shaft 12 corresponding to the vertical reciprocating stroke of the elevator car 4, the screw shaft 12 being in threaded engagement on its outer periphery with the internally threaded nut 11 fixedly mounted on the arm 10. As best seen from FIG. 4, the screw shaft 12 has an upper extension 12*a* vertically extending upward from the upper end thereof, the upper extension 12*a* having a large-diameter portion 12*b* which is connected with the screw shaft 12 and which is smaller in diameter than the screw shaft 12, and an externally threaded small-diameter portion 12*c* with an annular groove formed at its tip end.

Figure 4:
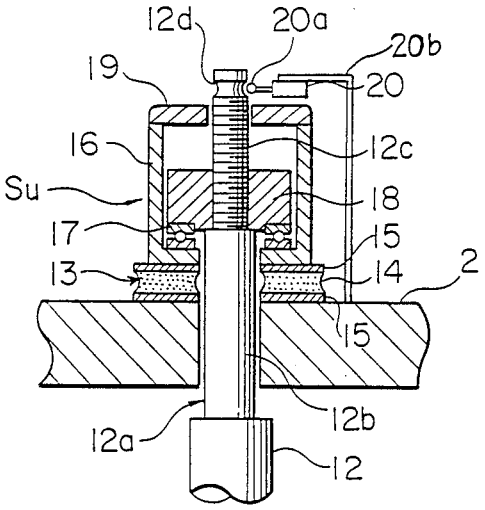
FIG. 4 is an enlarged cross sectional view showing how the upper end of a screw shaft is supported by a support beam.

As shown in FIG. 4, the screw shaft 12 is supported at its upper end by the support beam 2 through an upper support means Su which includes a vibration damper 13 fixedly mounted on the support beam 2 and composed of a vibration damping elastomeric member 14 clamped between a pair of metal plates 15, 15; a bearing box 16 secured to the vibration damper 13 and having a bottom wall through which the upper screw shaft extension 12*a* loosely extends for vertical motion relative thereto; a thrust bearing received in the bearing box 16 and disposed on the bottom surface of the bearing box 16; and a fastening member 18 in the form of a nut threaded over the small-diameter portion 12*c* of the screw shaft extension 12*a* and adapted to be placed, when tightened, in abutting engagement with both a shoulder defined between the large- and small-diameter portions 12*b* and 12*c* and the upper surface of the thrust bearing 17 so that the screw shaft 12 is thereby suspended from the support beam 2. A closure member 19 is secured to the upper end of the bearing box 16 for closing an upper opening thereof, and the screw shaft upper extension 12*a* loosely extends through the closure member 19 for vertical motion relative thereto. A micro-switch 20 is mounted through an inverted L-shaped bracket 20*b* on the support beam 2 and has an operation arm 20*a* which is in engagement with the annular groove 12*d* in the tip end of the threaded small-diameter portion 12*c* of the screw shaft extension 12*a* for detecting the vertical position of the screw shaft 12.

Turning again to FIG. 1, fixedly mounted on the bottom surface of the hoistway 1 is a bracket 21 to which a lower electric motor 22 is attached in a vertical manner. The lower electric motor 22 is disposed in a cut-out portion 23 formed at the lower side wall of the hoistway 1 at a location slightly outwardly of the hoistway 1. The cut-out portion 23 is closed by a cover 24. The lower electric motor 22 has an output rotary shaft which is drivingly connected with the screw shaft 12 through the intermediary of a driving spur gear wheel 25 and a driven spur gear wheel 26, the driving spur gear wheel 25 being fixedly mounted on the lower end of the rotary shaft of the lower electric motor 22 whereas the driven spur gear wheel 26 is fixedly mounted on the lower end of the screw shaft 12 and in meshing engagement with the driving spur gear wheel 25. The lower electric motor 22 and the driving and driven spur gear wheels 25 and 26 constitute a lower driving means 27 for driving the lower end of the screw shaft 12. A handle 28 can be detachably attached to the upper end of the motor rotary shaft for manual rotation thereof if needed, for example, during an emergency in the elevator system but in the normal operation the handle 28 is removed therefrom.

The lower bracket 21 has a horizontally disposed stop member 29 through which the screw shaft loosely extends for vertical sliding motion, the stop member 29 serving to cooperate with the driven spur gear wheel 26 on the screw shaft 12 so that when the screw shaft 12 is caused to displace upward relative to the lower bracket 21 and hence to the stop member 29, the driven spur gear wheel 26 is placed in abutting engagement with the stop member 29 thereby to stop and restrain the upward displacement of the screw shaft 12 within a predetermined limited range. In this connection, the arrangement is such that during the upward displacement of the screw shaft 12 within such a limited range, the driven spur gear wheel 26 is held engaged with the driving spur gear wheel 25.

Fixedly mounted on the upper portion of the hoistway 1 is an upper bracket 31 to which is attached an upper electric motor 32 having its output rotary shaft drivingly connected with the screw shaft 12 through the intermediary of a driving spur gear wheel 35 mounted on the rotary shaft and a driven spur gear wheel 36 mounted on the screw shaft 12, the upper electric motor 32 and the driving and driven spur gear wheels 35, 36 constituting an upper driving means 37 for driving the upper end of the screw shaft 12, in a manner similar to that of the lower driving means 27.

Figure 3:
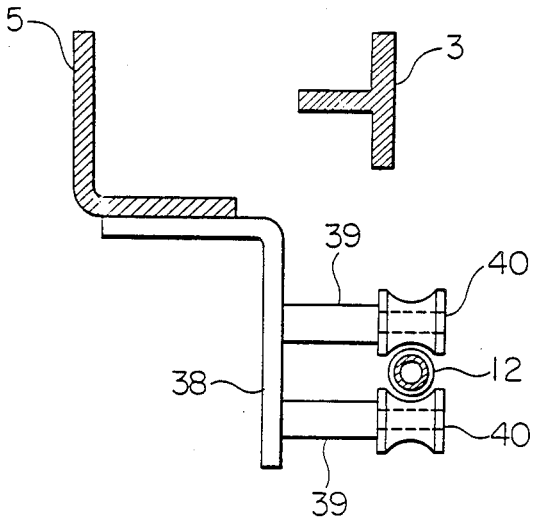
FIG. 3 is an enlarged cross sectional view showing guide members for guiding the vertical movement of a screw shaft shown in FIG. 1.

As clearly illustrated in FIG. 3, fixedly attached to the car frame 5 is a support arm 38 having a pair of support shafts 39, 39 fixedly secured thereto. Guide members 40, 40 each in the form of a roller having at its outer periphery an annular groove of arc-shaped cross section are rotatably mounted on the respective support shafts 39, 39. The screw shaft 12 is disposed between the guide rollers 40, 40 with a certain definite clearance formed between the outer peripheral surface of the screw shaft 12 and the annularly grooved outer peripheral surface of each guide roller 40.

Reference numerals 41 and 42 in FIG. 1 designate a lower buffer and an upper buffer, respectively, mounted on the bottom surface of the hoistway 1 and the lower surface of the support beam 2 for damping the downward and upward movements of the elevator car 4 when stopping.

Figure 5:
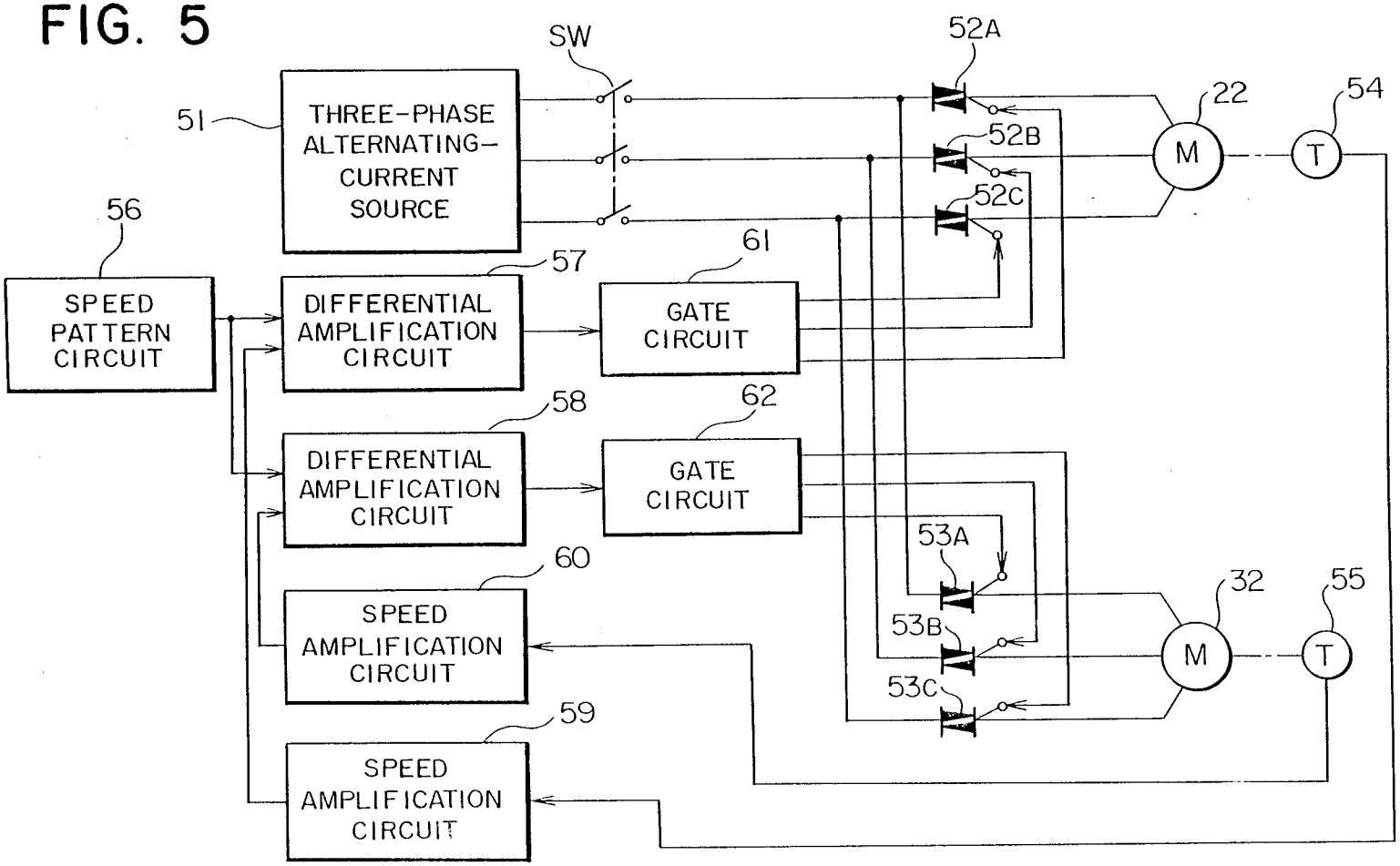
FIG. 5 is a circuit diagram of an electric circuit for controlling the operation of the elevator system illustrated in FIG. 1.

FIG. 5 is a circuit diagram showing an electric circuit for controlling the operation of the elevator system illustrated in FIGS. 1 through 4. The electric circuit as illustrated comprises a power source 51 for three-phase alternating current, first three bidirectional thyristors 52A to 52C connected between the alternating current source 51 and the lower electric motor 22, second three bidirectional thyristors 53A to 53C connected between the alternating current source 51 and the upper electric motor 32, a first generator 54 for a first speed indicator directly connected with the lower electric motor 22 for issuing a speed signal, a second generator 55 for a second speed indicator directly connected with the upper electric motor 32 for issuing a speed signal, a speed pattern circuit 56, a first differential amplification circuit 57 adapted to receive a speed instruction signal from the speed pattern circuit 56 and a speed signal from the first speed-indicator generator 54 via a first speed-amplification circuit 59, a second differential amplification circuit 58 adapted to receive a speed instruction signal from the speed pattern circuit 56 and a speed signal from the second speed-indicator generator 55 via a second speed-amplification circuit 60, a first gate circuit 61 connected with the first differential amplification circuit 57 for controlling the first bidirectional thyristor 52A to 52C, and a second gate circuit 62 connected with the second differential amplification circuit 58 for controlling the second bidirectional thyristor 53A to 53C.

With the elevator system as constructed in the above manner, the rotation speeds of the upper and lower electric motors 22 and 23 are controlled by a common instruction signal. Specifically, a common speed instruction signal from the speed pattern circuit 56 is fed to the first and second differential amplification circuits 57, 58 and there compared with speed signals from the first and second speed-indicator generators 54, 55, respectively so that the first and second differential amplification circuits 57, 58 operate to produce differential signals representative of the results of such comparisons, respectively, which are then fed to the first and second gate circuits 61, 62, respectively, so as to control the respective operations of the first bidirectional thyristors 52A to 52C and of the second bidirectional thyristors 53A to 53C. In this manner, the lower and upper electric motors 22, 23 are controlled through the first and second gate circuits 61, 62 to rotate at the same speed and in the same rotational direction at all times with a high level of precision.

When the lower and upper electric motors 22, 32 are driven to rotate in the above manner, the rotational forces of these electric motors are transmitted to the screw shaft 12 through the intermediary of the intermeshed driving and driven spur gear wheels 25, 26 and 35, 36 whereby the screw shaft 12 is caused to rotate in one direction by means of the lower and upper motors 22, 23. With this rotation of the screw shaft 12, the nut 11 in threaded engagement with the screw shaft 12 is forced to displace therealong in the upward or downward direction thereby to move the elevator car 4 in the same direction. During such vertical movement of the elevator car 4, it is guided along the guide rails 3, 3 through the guide rollers 9 rolling thereon so that the threaded outer surface of the screw shaft 12 and the threaded inner surface of the nut 11 are not subjected to any moment force due to a one-sided load of the elevator car 4 but only to a thrust force. Thus, the screw shaft 12 is not acted upon by any twisting force.

In addition, the screw shaft 12 loosely extends through the lower and upper brackets 21, 31 for free vertical movement, and the lower end of the screw shaft 12 is freely movable in the vertical direction and not restrained in any manner and the upper end of the screw shaft 12 is suspended from the support beam 2 through the support means 18 so that the screw shaft 12 is always acted upon by a tensile force. With this arrangement, the diameter of the screw shaft 12 can be reduced to a value just able to withstand a vertical load acting thereon.

In this manner, the screw shaft 12 is driven to rotate at the opposite ends thereof by means of the upper and lower driving means 27 and 37 which include the electric motors 22 and 32 rotating at the same speed so that the degree of torsional flexure of the screw shaft 12 can be reduced by half as compared with the case in which the screw shaft 12 is driven to rotate only at one end thereof by means of a single driving means. More particularly, in case the screw shaft 12 is driven to rotate at its lower or upper end alone by a single driving means, the screw shaft 12 will be subjected to great torsional and flexing forces when the elevator car 4 is remote from its lower or upper end or from such driving means, that is when the elevator car 4 is at the uppermost or lowermost floor. As a result, when the elevator car 4 begins to move or is being stopped, vibrations in the vertical direction due to the torsional and flexing force acting thereon arise, thereby giving the passengers unpleasant feelings. In order to improve such a situation, the torsional flexing force applied to the screw shaft 12 must be reduced and thus the diameter of the screw shaft must be enlarged. Such requirements will increase in scope as the vertical stroke of the elevator car 4 becomes greater, thus resulting in several disadvantages from the view points of installation space, production costs and the like.

In this connection, it will be understood that the torque distribution between the lower and upper electric motors 22 and 32 in the illustrated embodiment can be determined in the following manner so as to reduce the flexure of the screw shaft 12 to a minimum. Specifically, the two amounts of torque transmitted to the screw shaft 12 from the lower and upper driving means 27 and 37, respectively, are determined such that they are in inverse proportion to the distances between the position of the screw shaft 12 at which a rotational load is applied thereto (that is the position at which the nut 11 is engaged with the screw shaft 12) and the positions of the screw shaft 12 at which the lower and upper driven spur gear wheels 26 and 36 are mounted on the screw shaft 12.

Further, the following advantageous effects are obtained due to the arrangement that the screw shaft 12 is supported at its upper end by the thrust bearing 17 for vertical movement and displaceable at its lower end in the vertical direction within a limited distance until the lower driven spur gear wheel 26 fixedly mounted on the lower end of the screw shaft 12 abuts against the stopper member 29. Specifically, in order to prevent the overtravel of the elevator car 4 at the end of the upward and downward strokes, there are provided appropriate stopping devices (not shown), as employed in a conventional elevator system, so that the power supply to the electric motors 22 and 32 is interrupted upon actuation of the stopping devices.

On the other hand, in cases where the upward or downward movement of the elevator car 4 is stopped at a location intermediate the adjacent elevator halls or floors for some reason such as, for example, damage to the building, an overcurrent passing through the electric motor 22 or 32 is detected by an appropriate sensor (not shown) and the power switches SW are opened so that the power supply to the motor 22 or 32 is interrupted. Should the motors 22, 32 continue to rotate inspite of the fact that the upward or downward movement of the elevator car 4 is suppressed at a location intermediate the adjacent elevator halls or floors for some reason or inspite of the fact that the elevator car 4 passes through the lowermost or uppermost floor compressing the lower or upper buffer 41 or 42, the screw shaft 12 will be forced to continuously rotate. In this case, if the upper end of the screw shaft 12 is held against upward displacement, a compressive force will act on the screw shaft 12. In the illustrated embodiment, however, the upper end of the screw shaft 12 is supported in such a manner as to be movable in the upward direction whereby when an upward thrust is applied to the screw shaft 12, the driven spur gear wheel 26 is forced to move upward together with the screw shaft 12 within a limited distance until it abuts against the lower stop member 29. After abutment of the driven spur gear wheel 26 with the lower stop member 29, the torque or thrust forces of the lower and upper electric motors 22 and 32, being transmitted to the screw shaft 12 through the drive and driven spur gear wheels 25, 26 and 35, 36, act on the screw shaft 12 as upward tensile forces and therefore no compressive force acts on the screw shaft 12.

During the upward displacement of the screw shaft 12, the microswitch 20 is actuated by the operation arm 20*a* to open the power switches SW whereby the power source 51 is interrupted. In this connection, it is to be noted that if the upward travel of the elevator car 4 is restricted with the driving forces of the electric motors 22 and 32 acting on the screw shaft 12, the screw shaft 12 is pushed down under the action of a reaction force and subjected only to a tensile force, so that there is no fear of the screw shaft 12 being buckled. Therefore, in this state, the screw shaft 12 is acted upon by an overload and therefore, it is desirable to interrupt the power source 51 so as to eliminate the overload. In this embodiment, since the thrust bearing 17 is supported by the vibration damper 13 through the bottom portion of the bearing housing 16, the vibration damping elastomeric member 14 of the vibration damper 13 is compressed to an excessive extent so that the screw shaft 12 is forced to move downward while rotating relative to the support member 18 whereby the microswitch 20 is actuated by the upper end of the upper screw shaft extension 12*a* to open the power switches SW, thereby interrupting the power source 51.

In addition, since the thrust bearing 17 is supported on the support beam 2 through the vibration damper 13 in a vibration damping manner, it is possible to positively avoid the transmission of thrust bearing vibration to the building. Besides this, in the illustrated embodiment, there is no counterweight, hoisting rope or winding drum provided so that the hoistway 1 can be reduced in cross sectional area and no machine room is needed. Instead, it is only necessary to slightly project the lower and upper parts of one side wall of the hoistway 1 outwardly so as to accommodate respective parts of the lower and upper electric motors 22 and 32. This, in addition to the elimination of the need for any safety equipment such as an emergency stopping device or a governor, serves not only to reduce the installation space for an elevator system but also to simplify the construction thereof.

If it is assumed that the elevator system has some trouble and the elevator car 4 stops at a location intermediate adjacent elevator halls or floors and in such a case passengers are in the elevator cabin 6, it is desirable that the elevator car 4 be moved to the nearest elevator hall so the passengers may escape before the trouble is repaired. Such emergency escape can be effected by virtue of an emergency operation device which comprises the lower driven and driving spur gear wheels 25 and 26, the output rotary shaft 22*a* and the handle 28. More specifically, in an emergency situation, the handle 28 is attached to the upper end of the shaft 22*a*. Then, by turning the handle 22*a*, the turning force or torque is transmitted from the handle 22*a* to the screw shaft 12 through the shaft 22*a*, the lower driving and driven spur gear wheels 25 and 26 so that the screw shaft 12 is caused to rotate. With rotation of the screw shaft 12, the nut 11 in threaded engagement with the screw shaft 12 is forced to displace vertically along the screw shaft 12 whereby the elevator car 4 is moved in the vertical direction. In this connection, it should be noted that a brake mechanism (not shown), being generally provided on the lower driving means 27 alone, must be deactuated or released upon turning of the handle 28 attached to the motor rotary shaft 22*a*.

Though not shown in FIG. 5, a pair of encoders may be provided at the lower and upper ends of the screw shaft 12 for reducing the difference in rotation speed being applied to the screw shaft 12 at the lower and upper ends thereof to zero. With this arrangement, it is possible to control the rotation of the screw shaft 12 in a manner such that torsioning of the screw shaft 12 is further reduced.

As described in the foregoing, according to one aspect of the invention, there is provided an elevator system which comprises a screw shaft vertically disposed in a hoistway and adapted to be driven to rotate by a driving means, the screw shaft being supported at its upper end on one side wall of the hoistway by means of a thrust bearing for vertical movement and at its lower end on the same side wall of the hoistway by means of a support member for limited vertical movement, and a nut fixedly mounted on an elevator car in threaded engagement with the screw shaft, whereby when the screw shaft is driven to rotate by means of the driving means, the nut is caused to displace vertically along the screw shaft thereby to move the elevator car in the vertical direction. With this arrangement, if an excessively great force is applied to the screw shaft, for example, when the vertical movement of the elevator car is suppressed for some reason while the screw shaft is continuously driven to rotate, it acts on the screw shaft as a tensile force so that the screw shaft can sufficiently withstand such an overload. Moreover, the frictional engagement between the screw shaft and the nut serves to suppress a counter-rotation of the screw shaft so that there is no need for provision of a counterweight, a hoisting rope, a winding drum, a large-sized and complicated safety device including an emergency stopping mechanism, a governor and the like, and the driving means can be accommodated in the hoistway with one side wall thereof being only slightly projected outward. Accordingly, it is possible to provide a compact and inexpensive elevator system which needs only the smallest possible installation space and which is most suited for installation in small buildings such as private homes.

According to another aspect of the present invention, there is provided an elevator system which comprises a screw shaft vertically disposed in a hoistway and supported at its upper end on one side wall of the hoistway by means of a thrust bearing for vertical movement and at its lower end on the same side wall of the hoistway by means of a support member for limited vertical movement, a nut fixedly mounted on an elevator car in threaded engagement with the screw shaft, and an upper and a lower driving means for respectively rotating the upper and lower ends of the screw shaft in the same rotational direction, whereby when the screw shaft is driven to rotate by virtue of the upper and lower driving means, the nut is caused to displace vertically along the screw shaft thereby to move the elevator car in the vertical direction. With this arrangement, torsional forces acting on the screw shaft can be greatly reduced as compared with the case in which the screw shaft is driven to rotate by a single driving means, whereby the diameter of the screw shaft can be reduced to a value just able to withstand any tensile forces acting thereon. Further, counterweights and a machine room as conventionally employed can be omitted and there is provided a compact and inexpensive elevator system the operation of which is smooth in starting and stopping thereof, and which is most suited for installation in small buildings such as private homes.

What is claimed is:

1. An elevator system comprising:

a hoistway;

guide rail means vertically disposed in said hoistway;

an elevator car accommodated in said hoistway and movable in the vertical direction along said guide rail means;

a screw shaft vertically disposed in said hoistway and having a screw thread formed on the outer peripheral surface thereof;

a nut fixedly mounted on said elevator car and adapted to be threadedly engaged with said screw shaft;

an upper and a lower driving means disposed at upper and lower portions of said hoistway for driving upper and lower ends of said screw shaft at the same rotational speed in the same rotational direction such that said nut is moved along said screw shaft thereby to move said elevator car;

means for supporting said screw shaft for displacement within a limited range and preventing vertical displacement beyond said limited range such that, should said upper and lower driving means continue to drive said screw shaft when the upward or downward movement of the car is prevented, only tensile forces act on said screw shaft thereby to prevent buckling; and means for sensing reaction of said tensile forces acting thereon and for terminating the operation of said driving means actuated by said sensing means to prevent overload.

2. An elevator system as claimed in claim 1, wherein said upper and lower driving means have respective electric control circuits which are operated by input of a single speed instruction signal to control the driving speeds of said upper and lower driving means in a synchronized relation with each other.

3. An elevator system as claimed in claim 1, wherein said lower driving means has a rotary shaft provided with a handle mounting portion to which a manual handle is removably attached for manually rotating said screw shaft in case of an emergency.

4. An elevator system comprising:

a hoistway;

guide rail means vertically disposed in said hoistway;

an elevator car accommodated in said hoistway and movable in the vertical direction along said guide rail means;

a screw shaft vertically disposed in said hoistway and having a screw thread formed on the outer peripheral surface thereof;

a thrust bearing for supporting one end of said screw shaft for upward displacement;

a support means for supporting the other end of said screw shaft in a manner such that said screw shaft is permitted to displace vertically within a limited range but prevented from vertical displacement beyond said limited range;

a nut fixedly mounted on said elevator car and adapted to be threadedly engaged with said screw shaft; and a driving means disposed in said hoistway for rotating said screw shaft including upper and lower motors respectively disposed and connected to upper and lower ends of said screw shaft and rotating said ends of said screw shaft in the same rotational direction at the same rotational speed, so that when said screw shaft is rotated by said motors, said nut is moved along said screw shaft thereby to move said elevator car.

5. An elevator system as claimed in claim 4, wherein said driving means, said thrust bearing and said support means are all supported by a side wall of said hoistway.

6. An elevator system as claimed in claim 4, further comprising a support beam disposed horizontally in and secured at its opposite ends to said hoistway at its upper portion, the upper end of said screw shaft extending loosely through said support beam on which said thrust bearing for supporting one end of said screw shaft is mounted, said thrust bearing being engaged by a support member threaded on one end of said screw shaft, said support member being movable upward and serving to support said screw shaft in a manner such that said screw shaft is permitted to move upward.

7. An elevator system as claimed in claim 6, further comprising an elastomeric member disposed between said thrust bearing and said support beam for supporting said screw shaft in a vibration damping manner.

8. An elevator system as claimed in claim 4, wherein said motors each have a rotary shaft disposed in parallel with said screw shaft, and a gear transmission disposed between said electric motor and said screw shaft for transmitting the driving force of said electric motor to said screw shaft, said gear transmission comprising a driving spur gear wheel mounted on said rotary shaft of said electric motor and a driven spur gear wheel mounted on said screw shaft, said driving and driven gear wheels being in meshing engagement with said driving spur gear wheel for vertical displacement relative to each other so that the driving force of said electric motor is transmitted to said screw shaft through said driving and driven spur gear wheels with said screw shaft being displaceable in the vertical direction.

9. An elevator system comprising:

a hoistway;

guide rail means vertically disposed in said hoistway;

an elevator car accommodated in said hoistway and movable in the vertical direction along said guide rail means;

a screw shaft vertically disposed in said hoistway and having a screw thread formed on the outer peripheral surface thereof;

a thrust bearing for supporting one end of said screw shaft for upward displacement;

a support means for supporting the other end of said screw shaft in a manner such that said screw shaft is permitted to displace vertically within a limited range but prevented from vertical displacement beyond said limited range;

a nut fixedly mounted on said elevator car and adapted to be threadedly engaged with said screw shaft; and a driving means disposed in said hoistway for rotating said screw shaft so that when said screw shaft is rotated by said driving means, said nut is displaced vertically along said screw shaft thereby to move said elevator car, said driving means comprising:

an electric motor having an output rotary shaft, a gear transmission for transmitting the driving force of said electric motor to said screw shaft, said gear transmission having a driven gear wheel mounted on said output rotary shaft of said electric motor and a driven gear wheel mounted on said screw shaft in meshing engagement with said driving gear wheel, and said support means comprising a stop member fixedly secured to said hoistway and disposed just above and vertically spaced a limited distance away from said driven gear wheel on said screw shaft in a face-to-face relation.

10. An elevator system as claimed in claim 9, wherein said driving means is supported by a bracket fixedly mounted on said hoistway, said bracket having a portion thereof which is disposed near said screw shaft and which acts as said stop member.

11. An elevator system comprising:

a hoistway;

guide rail means vertically disposed in said hoistway;

an elevator car accommodated in said hoistway and movable in the vertical direction along said guide rail means;

a screw shaft vertically disposed in said hoistway and having a screw thread formed on the outer peripheral surface thereof;

a thrust bearing for supporting one end of said screw shaft for upward displacement;

a support means for supporting the other end of said screw shaft in a manner such that said screw shaft is permitted to displace vertically within a limited range but prevented from vertical displacement beyond said limited range;

a nut fixedly mounted on said elevator car and adapted to be threadedly engaged with said screw shaft;

a driving means disposed in said hoistway for rotating said screw shaft so that when said screw shaft is rotated by said driving means, said nut is displaced vertically along said screw shaft thereby to move said elevator car; and a detector means having an operation arm disposed in an opposed relation with a part of said screw shaft, said screw shaft being provided with an engagement part in an opposed relation with said operation arm, said operation arm being engageable with said engagement part of said screw shaft such that when said screw shaft has displaced vertically beyond a certain limit, said operation arm is actuated by said engagement part of said screw shaft whereby said detector means dectes excessive vertical displacement of said screw shaft and operates to stop said driving means.

12. An elevator system as claimed in claim 11, wherein said detector means is adapted to detect an excessive displacement of said screw shaft whenever said screw shaft excessively displaces upward or downward beyond a certain limit.

13. An elevator system as claimed in claim 12, wherein said screw shaft is suspended by a support member threaded on the upper end thereof, said support member being engaged with the upper end of said thrust bearing and movable in the upward direction so as to permit the upward displacement of said screw shaft, said screw shaft being able to displace downward when it is rotated relative to said support member, said detector means being actuated by the upward or downward displacement of said screw shaft beyond a certain limit.

* * * * *